United States Patent [19]

Zans et al.

[11] 4,355,928

[45] Oct. 26, 1982

[54] BACKLESS AERATION PAD FOR BULK CARGO CONVEYING BARGE OR THE LIKE

[75] Inventors: William A. Zans, St. Louis, Mo.; Edward F. Vander Meulen, Downers Grove, Ill.

[73] Assignee: Missouri Portland Cement Co., St. Louis, Mo.

[21] Appl. No.: 152,345

[22] Filed: May 22, 1980

[51] Int. Cl.[3] ..... B65G 53/22

[52] U.S. Cl. ..... 406/90

[58] Field of Search ..... 406/38, 39, 89, 90, 406/91, 138; 222/195; 366/101, 107

[56] References Cited

U.S. PATENT DOCUMENTS

| | | | |
|---|---|---|---|
| 2,805,897 | 9/1957 | Yellott | 406/90 |
| 3,009,607 | 11/1961 | Sayre | 406/90 |
| 3,226,166 | 12/1965 | Bertolini et al. | 406/90 |
| 3,375,042 | 3/1968 | Ostberg et al. | 406/90 |
| 3,409,333 | 11/1968 | Ostberg et al. | 406/90 |

*Primary Examiner*—Jeffrey V. Nase

*Attorney, Agent, or Firm*—Paul M. Denk

[57] ABSTRACT

An aeration pad for use contiguously upon a structured and inclined floor of a cargo transporting barge, railroad car, or other transporter, a combination of this pad and the floor are disposed for accommodating air under pressure intermediate thereof, and functioning as an air conveyor for stimulating the movement of the bulk granulated material, such as cement, for flow downwardly along the incline of the floor and towards a conveying or floor trough also provided within the structure of such transporters. A series of such aeration pads substantially cover the inclined floor of the barge, and around each pad's perimeter a series of channels cooperate with a seam located rope for holding the pads firmly in place, while an additional series of dividing channels secures each pad also to the floor to delineate elongated segments between channels and wherein air pockets may form as pressurized air is directed underneath the pads, with the perviousness of the pads allowing the air to effect shifting of this cementitious material towards the arranged lower conveying trough for discharge.

7 Claims, 7 Drawing Figures

BACKLESS AERATION PAD FOR BULK CARGO CONVEYING BARGE OR THE LIKE

BACKGROUND OF THE INVENTION

This invention relates generally to air conveyors, and more specifically pertains to a uniquely structured backless air pad for use in conjunction with the inclined floor of a barge or the like, for furnishing effective transferring of any cement laden thereon towards a flow trough for unloading. The usage of air conveyors for transferring granular or bulky material has long been available in the art. And, the use of such conveyors for unloading bulk cargo such as cement has also been known, with such being seen from the previous United States patents to Ostberg, et al., U.S. Pat. No. 3,375,042, and U.S. Pat. No. 3,409,333. But, as can be so clearly seen from the descriptive matter of these aforesaid patents, the formation of the air pads for their shown cement cargo carriers are fabricated from a pair of sheet material, comprising upper and lower sheets, wherein the upper sheet may be air pervious and the lower sheet being normally constructed of rather expensive and difficult to handle type of a neoprene liner that is impervious to any pressurized air injected intermediate these two said sheets. In addition, and in order to form segmented air pockets along the length of the shown prior art pads, this upper aeration pad and its lower impervious pad were stitched together, and after some degree of usage, this stitching would normally break, tear the sheet liner materials, resulting in the need for total replacement of these expensively formed prior art pads. Such has been found to be not only extremely expensive in the frequent replacement of these pads, but their continuing maintenance makes them almost prohibitive of usage. Furthermore, the type of neoprene or impervious rubberized backing material, forming the lower sheet of these prior art devices, is quite costly, and in addition, the installation of the entirely stitched pad is substantially time consuming, since the double liner pad, having this neoprene coated backing, is quite heavy in construction, necessitating the help of many maintenance men in their installation and maintenance.

Contrary to the foregoing, the current invention obviates the need or necessity for the second or lower impervious rubberized or plasticized liner as used in the prior art, thereby substantially diminishing the weight of the pad during installation, and only requires the layout of a singular light-weight and air pervious aeration pad upon the metal incline floor of the barge during its installation. Stitching of the type previously defined as needed for fabricating the prior type of pads has been eliminated, and in fact, no on-site stitching of any sort is now needed during installation and usage of this current invention.

It is, therefore, the principal object of this invention to provide a backless and singular layered aeration pad for use in forming the air pad for a granular material air conveyor, and more specifically, for a cement conveying barge.

Another object of this invention is to provide an air pad for a cement barge or other cargo transporter that eliminates the need for forming air pockets from fabric material, since this aeration pad is backless, and dispenses with the need for any backing material.

Another object of this invention is to provide an aeration pad for a cement barge that forms its segmental air cushions or chambers through the usage of a series of prearranged channels that firmly locate said pad upon the inclined structured floor of the barge or the like.

Yet another object of this invention is to provide an air distributor for an aeration pad that uniformly directs its pressurized air laterally of the pad before such enters into the segmental air chambers of the formed pad.

Yet a further object of this invention is to provide an air distributor for an air conveyor that is structurally of low profile.

Still another object of this invention is to provide an aeration pad for an air conveyor that is reinforced through the application of multiarranged loop stitching horizontally acreoss the fabricated pad.

Still another object of this invention is to provide an aeration pad for a cargo barge that is inexpensive to manufacture, easily installed, due to its light weight, by a minimum of maintenance men, and yet functions just as effectively if not more so than aeration pads available in the prior art.

These and other objects will become more apparent to those skilled in the art upon reviewing the summary of this invention, and upon undertaking a study of its perferred embodiment, in view of the drawings.

SUMMARY OF THE INVENTION

This invention contemplates the formation of a backless aeration pad for a bulk cargo conveying barge, and more specifically a type of air pad that is formed of a singular layer of material that functions in cooperation with the structured floor of the barge, for furnishing all the necessary force needed for providing air conveyance of granular material, such as cement, or the like. It might be stated herein that the invention may be used in conjunction with the structured floor for a barge, as previously alluded to, or it is just as likely that the combination of elements forming the air conveyor of this development could be used for also furnishing air conveyance within railroad cars, trucks, storage silos, and any other structured floor that is normally intended to be utilized for supporting fine granular material, but which periodically must be unloaded from the same. It is the fluidizing effect upon such granular material through the effort of conducting pressurized air through the air permeable aeration pad, in this particular instance being only a singular pad necessary to fulfill all requirements for air conveyance. The granular cargo then flows by way of gravity, and turbulent blowing, to a discharge pipe or any other means that will evacuate the shifted material, such as cement, after it has been air conveyed through the usage of this invention to a localized and usually lowermost point. The cement is then completely removed from its location of storage, as during transportation, upon the structured flooring and air pad of this invention.

More specifically, and where the concept of this invention is used in a barge, usually a series of inclined floor structures are provided above the bottom or base of the barge, with these inclined floors being oriented generally in a direction towards each other, and emptying into a flow trough normally arranged longitudinally centrally along the center line of the barge. At particular central segments, where the flow troughs converge together at a lowermost point in the barge, it is at this point where the cement is usually evacuated from the barge as by a suction or pumping process into discharge pipes.

In the specific construction of each of the inclined structured floors, and with the air pad being arranged thereupon, the normal air receiving pocket as used in conveyors of this type, in this instance, is formed from only a singular layer of permeable material that is arranged contiguously upon almost all of the surface of the said inclined floors. The perimeter or margin of the pad is structured to include some formed bulk, at these locations, generally through the introduction of a rope within a marginal seam around the periphery of the pad, so that when perimeter channel means are bolted into place upon the floor, they straddle these marginal ropes in order to assure that the pad remains in place even when functioning as an air conveyor during the admission of pressurized air intermediate the said pad and the structured floor. In addition, and as previously alluded to, in order to eliminate the substantial problems encountered by the prior art of having stitching constantly breaking at those locations where an upper and lower pad are secured together to form the elongated air pockets, the current invention reinforces the singular pad at those locations where supplemental or divisional type channel means are arranged for tight fastening against the floor, and therein structurally form these elongated and reinforced air pockets up along the incline of the structured floor. But, the length of these divisional channels fall short of the entire heighth of the now arranged inclined pad, so that clearance is provided along the upper edge of the pad, entirely along its length, in order to form a distribution conduit for the pressurized air therethrough so that the air may be evenly distributed downwardly into each of the formed pocket segments arranged between the divisional channel means and the side margin channel means that tightly bind the pad to the inclined structured floor for the barge.

BRIEF DESCRIPTION OF THE DRAWINGS

In the drawings, FIG. 1 provides an isometric view of an opened barge disclosing the location of the structured floors and aeration pads of this particular invention.

DESCRIPTION OF THE PREFERRED EMBODIMENT

Figure 1:
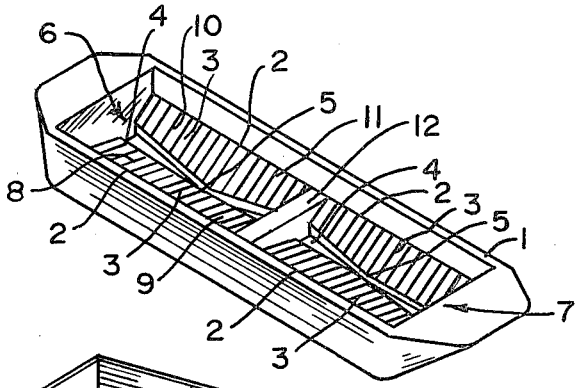

In referring to the drawings, and in particular FIG. 1, there is shown an opened barge 1 which has been constructed for use for the purposes of this invention, and that is incorporating the inclined structured floors 2 having a series of aeration pads 3 of this invention secured thereupon. Arranged intermediate these floors and pads are the flow troughs 4 which, after the cement has been turbulently forced by means of pressurized air to flow by way of gravity down the incline of the barge floors, enters into these troughs and is moved by air slides to flow towards central locations, as at 5, where the cement is evacuated through discharge pipes by pumps for transfer to other locations normally on land for storage.

Generally, the barges are constructed into two segments, that being the segments 6 and 7, as shown. Each of these segments is formed having at least four of the structured floors and accompanying air pads of this invention arranged in converging formations, with each of these floors and accompanying air pads of this invention arranged in converging formations, with each of these floors being directed upon incline towards each other, not only in a direction towards the centralized flow troughs 4, but in addition, adjacent floors arranged lengthwise with respect to each other are also inclined longitudinally of the shown vessel. For example, the four floor constructions for the barge segment 6 may be identified at 8 through 11, and not only do the segments 8 and 9 incline in a direction towards the centralized trough 4, but likewise the segment 10 and 11 also incline downwardly towards the same trough. But in addition, the segments 8 and 10 may also incline lengthwise, from their back end towards the mid-point of the segment 6, with the segment 9 and 11 likewise inclining from the location of the bulkhead 12 and towards the low points between the segments 8 and 10, where they all join together. Hence, and as can be understood, the central locations 5 for each of the segments 6 and 7 are the lowermost points for the barge, so that when the air conveyor to be hereinafter described is properly working, all of the cement will gradually flow by means of gravity, and through the influence of the pressure and slope of the fluidizing air conveyor towards these lowermost locations 5 of the barge where discharge pipes and suction pumps will substantially draw out most of the cement or other granular material that has been conveyed on the barge.

Figure 2:
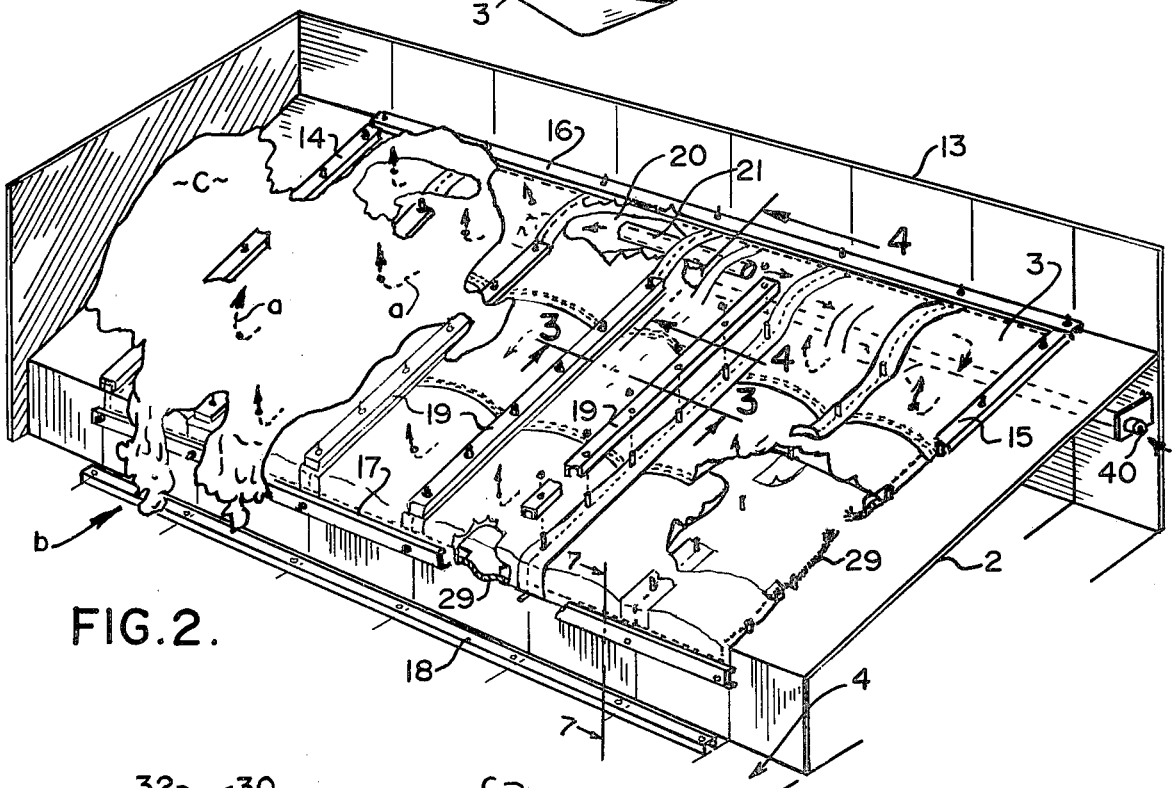
FIG. 2 provides a segmental view of one of the inclined floors of this invention, with the aeration pad being secured by means of the channels thereon, and further disclosing the flow trough into which some of the cement is being diverted through the efforts of the pressurized air that permeates up through the aeration pad and the laden cement.

In referring to FIG. 2, which may comprise one of the floor segments 8 through 11, as previously identified, it can be seen that the structured floor 2 is arranged upon an incline, leading from its uppermost point of attachment to the sidewall 13 of the barge, and down to where the lowermost point of the floor 2 empties into the identified flow trough 4. Also shown within this figure is the singular layered aeration pad 3 of this invention, and as can be seen, it is arranged for providing substantial covering over most of the inclined floor 2, being held in position by a series of channels, as to be hereinafter defined. The combination of perimeter channels 14 and 15 rigidly secure the side edges of the pad to the floor 2, while the upper perimeter channel means 16 obviously secures at this location to the same floor 2. At its lowermost edge, the channel means 17 secures the downward edge of the aeration pad to the floor 2, and as can be seen, its location is desirably around the bend of the structured floor and where it integrally extends into the flow trough 4 for the barge. Another channel means 18 may be provided within the trough and act as a retainer for the air slide arranged therein. Such air slides are conventional in the art. Hence, as can be seen, the entire pad is secured completely around its perimeter to the inclined floor 2, and in this relationship, forms a pocket with the floor and into which pressurized air may flow during functioning of the air conveyor of this development.

It is desirable, for aeration pads of this type, that individual segments or pockets in the pad be formed partially upwardly along the heighth of the inclined floor, and its pad, and as can be seen for this invention, a series of divisional channel means 19 are provided, and these extend from the lowermost edge of the inclined floor to and upwardly along the heighth of the floor but terminate short of its upper edge. The reason for this is to leave an air conduit or space, as at 20, along the upper margin of the air pad, and it is through this air space, which is formed intermediate the upper ends of the divisional channels 19, and the upper perimeter channel 16, that the pressurized air emanating from the distributor 21 may flow laterally of the aeration pad, so that it may be evenly distributed into the various air pockets formed intermediate the divisional channels 19, as shown.

The singular layered aeration pad of this invention, as previously explained, is generally constructed as a woven fabric, having miniscule air passages through it so that the pad is totally pervious to air under pressure delivered intermediate it and the structured floor 2 of the barge. Usually air pressure in the vicinity of 5 to 10 psi or more is used in installations of this type. And, the fabric of this invention is the type that may be acquired from H. W. Carlsen, Ltd. of Malmo, Sweden.

Figure 4:
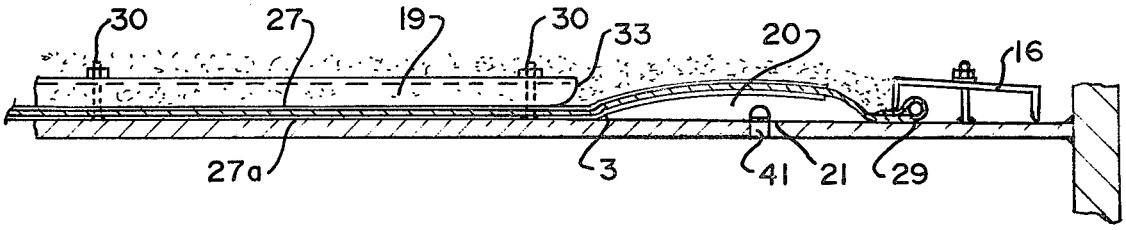
FIG. 4 provides a sectional view showing the upper part of one of the air pockets, and the formed air conduit space arranged along the upper margin of the inclined floor, essentially taken along the line 4—4 of FIG. 2.
Figure 5:
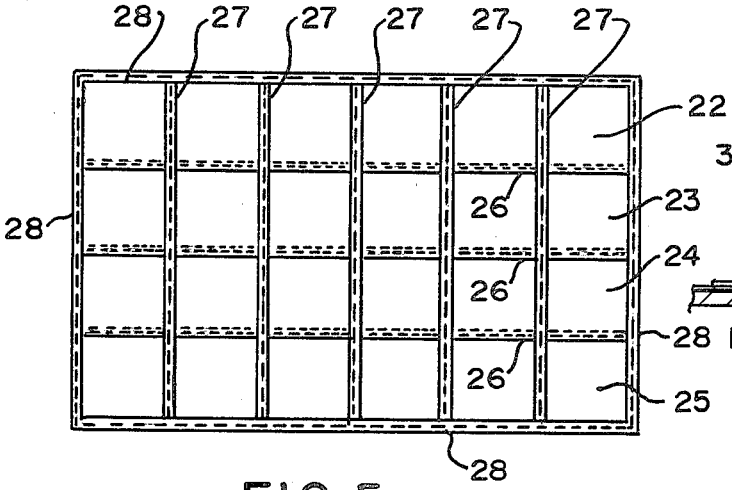
FIG. 5 provides a plan schematic view of one of the pads, in its entirety, prior to its locating upon the structured floor for the barge.

In referring to FIG. 5, it can be seen that the pad is fabricated from a series of sections of the fabric material, as at 22 through 25, and which are quad-stitched together, or through any other form of securement, as along each of its four rows of loop stitched seams, as at 26, and which seams generally provide sufficient reinforcement in a horizontal direction for the formed pad. Obviously, if the bolt of material from which the pad is formed could be fabricated to dimensions equivalent to the heighth of the pad, then such seams would be obviated but the inclusion of the seams therein are thus done so for the sake of convenience to adhere sections of the fabric together, and for the further reason of providing horizontal reinforcement across the pad as shown. Extending upwardly along the pad are a series of reinforcing tapes 27, and these tapes are provided for adding reinforcement to the pad at those locations where the divisional channels 19 are emplaced. In addition, and as previously briefly alluded to, around the perimeter of the pad there is formed an additional seam, as at 28, and stitched within these marginal seams is some rope material, such as at 29 in FIGS. 2 and 4, so as to furnish some raised portion around the periphery of the pad and add sufficient bulk that can be straddled by the perimeter channel means 14 through 19 as the latter connect to the structured floor 2 during the installation of one of these pads. Such bulk producing means may comprise a rope, such as sisal rope, and assure that the margins of the pad will remain firmly in place, particularly when air under pressure is being delivered between it and its contiguous floor.

Figure 3:
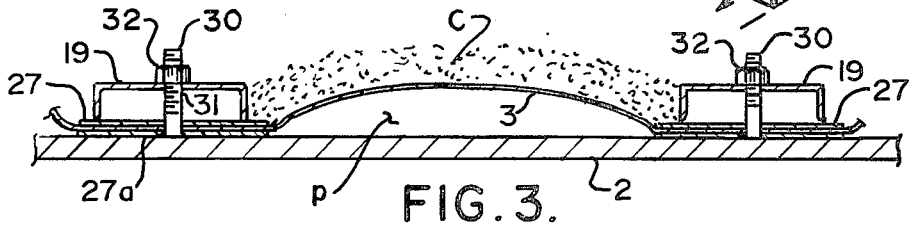
FIG. 3 provides a sectional view across a pair of the divisional channel means and one of the formed air pockets essentially taken along the line 3—3 of FIG. 2.

As can be seen in FIG. 3, when the aeration means is properly operating, a quantity of cement, as at C, will be resting upon the pad, with the pad being firmly secured in place for forming its arranged air pockets, as at P, between the pad 3 and the floor 2 of the vessel. The air pockets P are formed intermediate the divisional channels 19, or between one of the channels 19 and its adjacent marginal channel 14 or 15. See also FIG. 2. The pad 3 is reinforced, as previously explained, through the arrangement of the tapes 27, to prevent the flanges of the said channels 19 from cutting the pad canvas at these locations. In addition, and to provide means for fastening of said channels 19, and also the channels 14 through 18 to the floor structure, or the trough, a series or fasteners, such as the bolts generally shown at 30, are secured to the floor structure, as by means of welding, or any other method of fastening, and extend upwardly through slits provided through the pad 3, its attached tapes 27, and further upwardly through aligned apertures, as at 31, provided through the base of each of the identified channel means. In addition, fasteners, such as the nuts 32 are shown, are provided for securing onto the bolts 30, or tightened in place, thereby rigidly securing the channel means on the aeration pad at all locations as shown directly to the structured floor 2, or th the walls or base of the flow trough 4.

As can also be seen in FIG. 4, the divisional channels 19 terminate short of the upper marginal edge of the aeration pad 3, thereby forming a spacing between the channel terminus 33 and the upper marginal channel 16 that secures the upper end of the pad in place. Thus, and as previously explained, a lateral conduit, as at 20, is naturally formed along the upper area of the pad, so that air under pressure admitted through the distributor 21 is free to pass laterally along the entire length of the upper part of the pad, and be distributed down into the various formed air pockets P that are arranged between each of the divisional channels 19 and the perimeter channels 14 and 15. Each divisional channel is contoured, and closed as at its ends 33, to seal and prevent tearing of the contiguous pad at these locations. See FIGS. 4 and 7.

Figure 6:
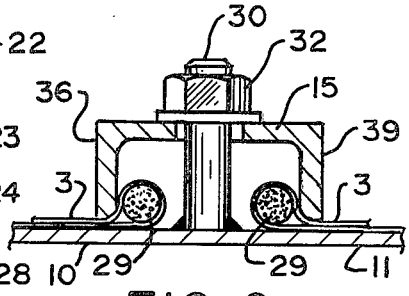
FIG. 6 discloses a sectional view showing how two adjacent pads may be bound together against the structured floor through the use of one of the marginal holding channel means of this invention.
Figure 7:
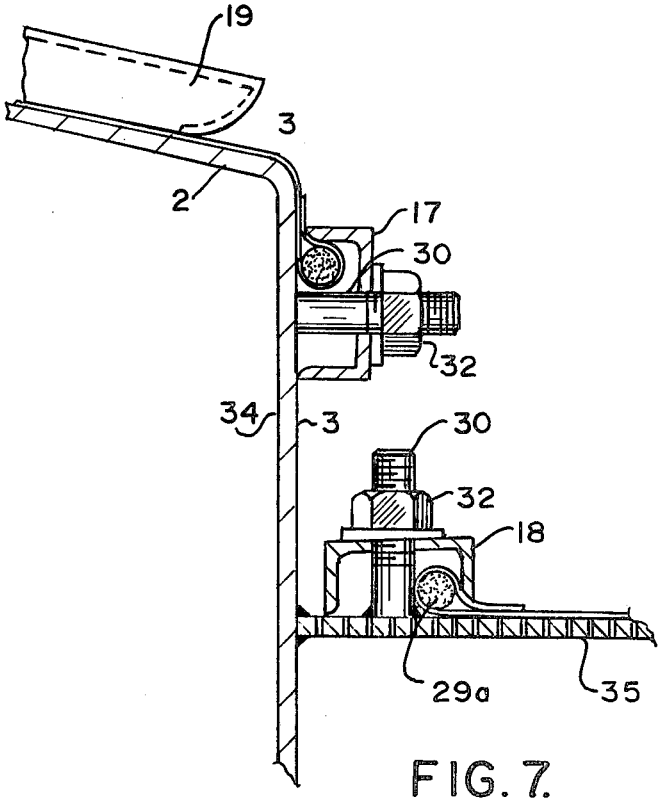
FIG. 7 shows a sectional view of the lower end of the inclined floor, where it forms into the flow trough for the barge, essentially taken along the line 7—7 of FIG. 2.

As shown in FIG. 7, the lower ends of the divisional channels 19 terminate approximate the lower edge of the structure floor 2, but the canvas aeration pad 3 may be turned at this location and extend partially down the side wall 34 of the flow trough, where it may be fixed into position by means of the lower marginal channel 17. Obviously, this channel is held in place by means of additional fasteners 30 with their threadedly attaching nuts 32 rigidly securing such channel in place. The rope 29 assures retention of this lower end of the pad by the retention channel 17. The air slide provided at the bottom of the trough has its canvas and rope secured by means of the channel 18. Once again the fasteners 30 and 32 affix the perimeter channel 18 in place, and in a manner that straddles the seam located rope **29*a*** thereby preventing it from ever coming loosened from the channel flanges as shown.

Where a pair of the aeration pads come together along the juncture between floor segments 8 and 9, or 10 and 11, as previously explained, it may be desirable to provide an additional channel that may embrace both of the juxtaposed marginal edges of these adjacent pads. As can be seen in FIG. 6, the pad 3 associated with, for example, the floor segment 10 may have its embraced cord 29 secured by means of the channel means flange 36, while the cord 29 of the adjacent pad 3 associated with the floor segment 11 may be embraced by the opposite integral flange 39 of the same channel means 15. Once again, the fasteners 30 and 32, the former being welded to the structured floor 2, are arranged for tight securement of the channel means 18 for embracing these identified marginal edges of the shown air slide.

It may be desirable, but perhaps not necessary, to provide additional reinforcement to the pad at those locations where the divisional channels 19 secure it, and it can be seen, as in FIGS. 3 and 4, that in addition to providing a reinforcing tape 27 upon the upper surface of the pad, just under each of the identified channels, it may be in the best interests for pad reinforcement to include another such reinforcing tape 27*a* to its underside thereof.

In operation, the air under pressure from a pump or source (not shown) enters through the pipe 40 through the spur line 41 and into the distributor 21. Air is discharged laterally from either end of the distributor 21 (See FIG. 2 and the air flow line arrows, as shown) with the air traversing immediately downward the adjacent air pockets P formed intermediate the divisional channel means 19, with other air passing laterally down the air passage 20 for eventual entrance into the more remote air pockets particularly those located between the marginal channel means 14 and 15 and their next adjacent division channels 19. When this occurs, the air permeates upwardly through the aeration pad 3, and causes a turbulent uplifting of the cement resting upon the pad, at least of sufficient turbulence to cause the cement to commence to flow under the influence of gravity towards the shown floor trough 4. At this location, once the cement flows into the flow trough, it is conveyed towards its centralized segments 5, as previously explained, by methods that are known in the art. This uplifting of the cement can be seen in FIG. 2, by the shown schematic directional air flow arrows 1*a*, so that as the cement is gradually uplifted, to some degree, from the aeration pad, it is then caused to avalanche off of the inclined structured floor 2 and into the trough, as shown at B. When all of the cement has been blown from and moved into the trough 4 and while the pressurized air source is still operating, the pad undertakes the rather ballooned appearance at the vicinity of its formed air pockets, and along its lateral air passage 20, in the manner as shown in these FIGS. 2 through 4.

Various modifications or changes to the fabrication of this air pad, or the structure of its inclined floor as identified herein, or for that matter, any aspects of this invention, may occur to those skilled in the art upon reviewing the subject matter of this invention. Any such variations or modifications if within the spirit of this invention are intended to be encompassed by the scope of any claims to patent protection issuing upon this invention. The description of the preferred embodiment set forth herein is analyzed for illustrative purposes only.

Having thus described the invention what is claimed and desired to be secured by Letters Patent is:

1. A backless aeration pad structure for a bulk cargo conveying barge, railroad car, or similar transporter, and for use in transferring and unloading granular materials such as cement or the like, comprising, a structured floor provided within the barge and being inclined towards the location of a lower floor trough, a singular layered aeration pad provided upon said floor and for furnishing substantial coverage thereon, air supplying means provided on said floor for delivering air under pressure intermediate to said floor and its aeration pad, said structured floor being substantially air impervious, the aeration pad formed to provide passage of the pressurized air therethrough for effecting air induced movement of the cementious or other material located thereon towards the flow trough, said aeration pad being formed of a cloth material having miniscule openings therethrough for allowing passage of the pressurized air from the spacing intermediate said pad and the structured floor, means provided around the perimeter of said pad for providing it substantially with a raised margin, perimeter channel means also provided around the margin of said pad and being fixed to said floor and straddling the pad raised portions to reasonably locate said pad fixedly in place to said floor, said pad in cooperation with the structured floor defining segmentally divided and elongated air chambers over a substantial portion of the pads height, said pad being additionally secured contiguously to the structured floor along intermediate and pad division lines that create narrow and interconnected air chambers over a substantial portion of the pads height, the area between adjacent air chambers providing lines of pad division, pad reinforcing means provided upon said lines of pad division, divisional channel means provided upon said pad reinforcing means and being fixed to said floor to secure and delineate the said aeration pad into the aforesaid integrally elongated air chambers, said division channel means sealing said aeration pad at its lines of division to the said structured floor, that portion of the pads height above the upper ends of the divisional channel means but below the upper disposed perimeter channel means remaining unattached to the structured floor therebeneath and capable of forming a space intermediate to the aeration pad and the structured floor for delivering air under pressure laterally across the approximate upper margin of the pad and for its eventual distribution downwardly into the air chambers formed between the located divisional channel means, said air supplying means comprising an air nozzle arranged approximately through the upper central portion of the structured floor and designed for delivering air under pressure at this location between the aeration pad and its said proximate structured floor.

2. The invention of claim 1 and including a distributor attaching with the nozzle for directing the pressurized air laterally of the pad.

3. The invention of claim 1 and wherein the lower edge of the aeration pad is arranged into the flow trough, and the perimeter channel means securing said lower edge also being located within said trough.

4. The invention of claim 1 and wherein there are at least a pair of structured floors provided within the barge, said floors being inclined towards each other, and the flow trough provided between said floors at their lower edges thereof.

5. The invention of claim 1 and wherein there are at least four structured floors provided in each barge, each of said floors being inclined towards the intermediately arranged floor trough and also being inclined in their location towards each other and towards a central segment of the barge.

6. The invention of claim 1 and wherein said cloth material forming the aeration pad is a polyester fabric.

7. The invention of claim 1 and including a series of fasteners securing with the said structured floor, said fasteners disposed for retaining the said channel means and pad tightly to the said floor, each fastener comprising a bolt, each bolt being welded to the said structured floor and projecting upwardly therefrom, aligned apertures provided through each channel means and pad and for accommodating the insertion of a bolt therethrough, and a nut for fastening upon each bolt and securing the channel means and aeration pads contiguously to the said structured floor.

* * * * *